United States Patent [19]

Widmyer

[11] 4,353,417

[45] Oct. 12, 1982

[54] METHOD FOR PRODUCING A WELL IN AN UNCONSOLIDATED FORMATION

[75] Inventor: Richard H. Widmyer, Houston, Tex.

[73] Assignee: Texaco Inc., White Plains, N.Y.

[21] Appl. No.: 210,875

[22] Filed: Nov. 28, 1980

[51] Int. Cl.[3] ..... E21B 43/04

[52] U.S. Cl. ..... 166/250; 166/278; 166/303; 175/67

[58] Field of Search ..... 166/51, 278, 276, 303, 166/306, 250; 299/16, 17; 175/67

[56] References Cited

U.S. PATENT DOCUMENTS

| | | | |
|---|---|---|---|
| 2,652,117 | 9/1953 | Arendt et al. | 166/278 |
| 2,693,854 | 11/1954 | Abendroth | 166/278 |
| 2,998,065 | 8/1961 | Hildebrandt | 166/278 |
| 3,353,599 | 11/1967 | Swift | 166/278 |
| 3,822,750 | 7/1974 | Ping | 166/309 |
| 3,951,457 | 4/1976 | Redford | 166/303 |
| 4,066,127 | 1/1978 | Harnsberger | 166/278 |
| 4,114,691 | 6/1978 | Payton | 166/276 |
| 4,124,074 | 11/1978 | Allen et al. | 166/278 |

*Primary Examiner*—Stephen J. Novosad
*Attorney, Agent, or Firm*—Carl G. Ries; Jack H. Park; Theron H. Nichols

[57] ABSTRACT

A method for producing a well in an unconsolidated formation by forming a sand pack in the well by applying and maintaining a high positive pressure against the cavity walls to prevent cave-in and sloughing of the formation cavity walls until the sand pack is formed comprises (1) controlling the ingress and egress of fluids and removed formation material from inner and outer annuli with a high pressure wash pipe in the well with control valves in each.

19 Claims, 7 Drawing Figures

P
21
11
V
12
19
15
22
V
P
ANNULUS 14
20
23
17
10
18
24
P
V
V
P
ANNULUS 16
13
29
28
25
27
26
24

METHOD FOR PRODUCING A WELL IN AN UNCONSOLIDATED FORMATION

BACKGROUND OF THE INVENTION

This invention pertains to a method of sand control for increased production of liquids from unconsolidated, petroliferous formations. Basically, this invention solves the problem of cave-in and sloughing during drilling, enlargement, i.e., underreaming, gravel and screen placement, and/or liner placement.

It is most desirable to utilize a large gravel or sand pack. The larger the sand pack, the more surface is available for sand pack drainage and for filtering for increased production of oil from the well. To form a large gravel pack, increased underreaming of the open hole below the casing for forming a larger cavity is required. Thus in unconsolidated sand formation the result is formation cave-in and sloughing thereof and during the subsequent steps of forming and placing the sand pack and screen and/or liner placement.

For solving this problem, this invention includes the novel method steps for maintaining the sides of the unconsolidated formation under high positive pressure at all times from the time the high pressure fluid jetting starts forming the cavity in the well until a sand pack is completed for production of the well. This problem is prevalent, for example, from the formerly Texaco Slocum Field (bought in about 1902) in Anderson County, Texas to the Athabasca Tar Sands of Canada.

OBJECTS OF THE INVENTION

Accordingly, a primary object of this invention is to provide in a well for a novel method for preventing cave-in and sloughing of the unconsolidated formation well walls until a sand pack is formed.

A further object of this invention is to provide a method for preventing cave-in and sloughing in a well while working in the well that is easy to operate, comprises simple method steps, is economical to operate and implement, and is of greater efficiency.

Other objects and various advantages of the disclosed methods for sand control of unconsolidated sand formation will be apparent from the following detailed description, together with the accompanying drawings, submitted for purposes of illustration only and not intended to define the scope of the invention, reference being made for that purpose of the subjoined claims.

BRIEF DESCRIPTION OF THE DRAWINGS

The drawings diagrammatically illustrate by way of example, not by way of limitation, one form of the invention for carrying out the novel method wherein like reference numerals designate corresponding parts in the several views in which.

Figure 1:
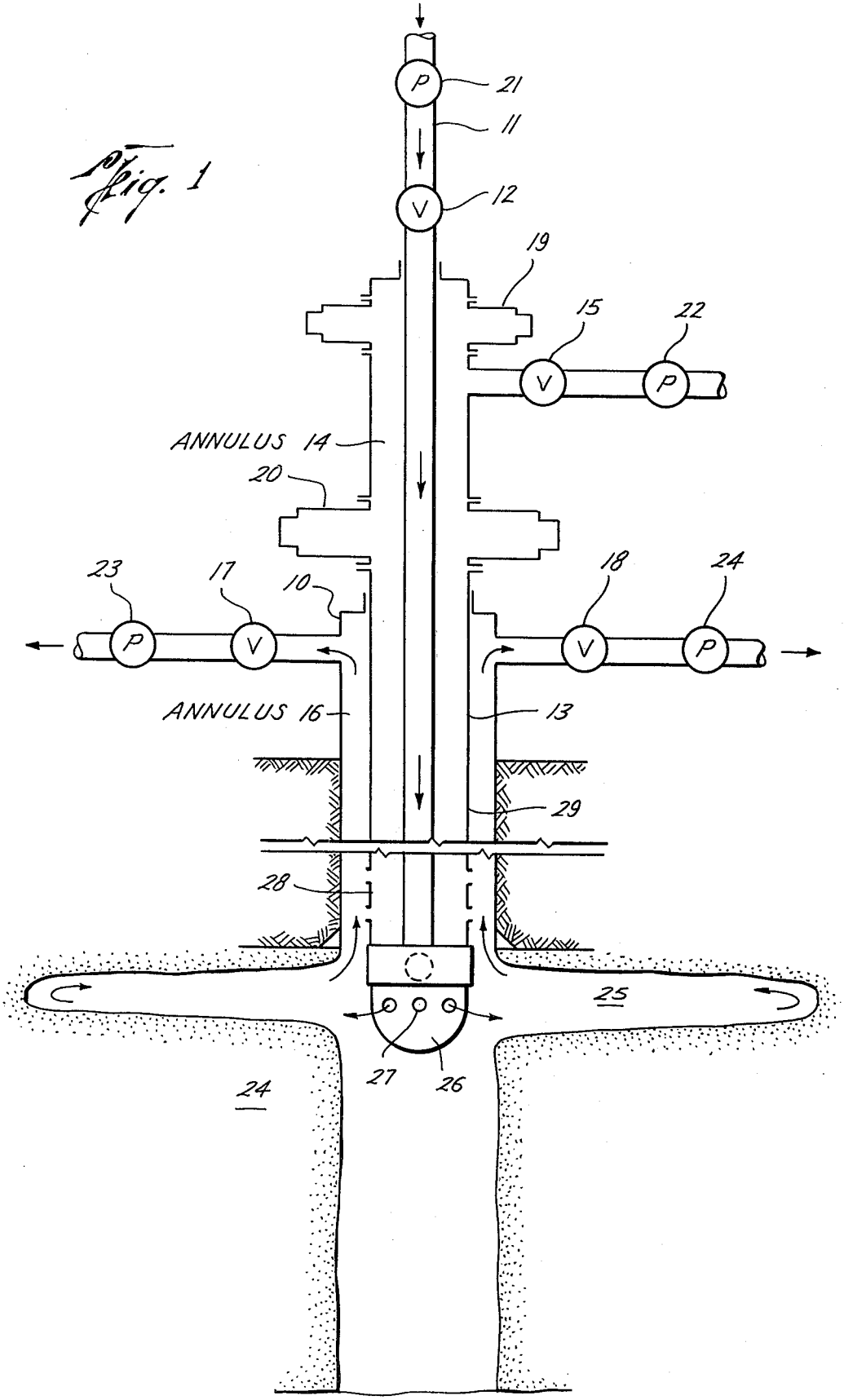
FIG. 1 is a schematic diagrammatic vertical sectional view of an apparatus for carrying out the method for sand control of unconsolidated sand formation in which it is just starting to wash out an enlarged cavity for a large sand pack.

The invention disclosed herein, the scope of which being defined in the appended claims is not limited in its application to the new method and to the details of construction and arrangement of parts shown and described, since the invention is capable of other method steps and of other embodiments for carrying out the methods and of being practiced or carried out in various other ways. Also, it is to be understood that the phraseology of terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

METHOD OF SAND CONTROL IN AN UNCONSOLIDATED PETROLIFEROUS SAND FORMATION

A method of sand control in an unconsolidated petroliferous sand formation is disclosed which comprises reversal of circulation in the well while forming a cavity in the well and during placement of the screen and/or liner and the gravel packs, and it comprises prevention of caving-in and sloughing of the formation cavity walls by maintaining a high fluid pressure against the cavity walls during the reversal of circulation. In a well having an outer annulus formed between a screen supporting tube suspended in the well and the sides of the well, and an inner annulus formed between the screen and screen supporting tube and a wash pipe suspended therein for having high pressure wash liquids flowing down the wash pipe for washing out a cavity in the petroliferous sand formation with the fluids and removed material exhausting up and through the outer annulus to the surface, this method comprises basically the following step, (1) controlling the valves in both annuli for controlling the exhaust spent fluids and removed formation material from the outer annulus as it flows up from the cavity for maintaining a high fluid pressure against the walls of the cavity higher than the overburden pressure in the walls for preventing cave-in and sloughing of the unconsolidated formation well walls until a sand pack is formed.

In greater detail, the basic method may include the following method step, (1) washing out the cavity with a nozzle having at least two 180° spaced apart orifices for efficient removal of the unconsolidated formation well walls.

A further step including more details includes, (2) injecting cold wash water, hot wash water, and steam in consecutive order while continuously maintaining high fluid pressure to resist the overburden and for prevention of thermal shock in the unconsolidated sand formation.

A still further detailed method step comprises, (3) gradually beginning exit flow of the spent drilling fluid and removed formation material up out of the inner annulus with gradual ceasing of flow from the outer annulus while maintaining high fluid pressure against the overburden for preventing cave-in and sloughing of the unconsolidated formation well walls.

Another detailed method step comprises, (1) controlling the ingress and egress of fluids and removed formation material from inner and outer annuli and a high pressure wash pipe in the well with control valves in each.

Further, the detailed method may be expressed thus:

(1) removing any production tubing from the well, (2) supporting a nozzle from the bottom of a wash pipe, (3) surrounding the wash pipe with a screen supported by a screen support tubing forming an inner annulus between the wash pipe and the screen support tubing and forming an outer annulus between the screen support tubing and the wall of the well, from the top of the unconsolidated sand formation to the bottom thereof, (4) injecting high pressure fluid down the wash pipe and out the horizontal nozzle for forming a cavity in the petroliferous sand formation and discharging the removed material up through the other annulus, (5) controlling fluid flow through each of the three conduits comprising the wash pipe, the inner annulus, and the outer annulus for maintaining the cavity under high fluid pressure to prevent caving-in and sloughing of the formation walls, (6) opening the inner annulus and closing the outer annulus for causing high pressure injection fluid flow into the cavity from the wash pipe and through the screen to exit from the inner annulus, while continually maintaining the high fluid pressure against the cavity walls, (7) opening the outer annulus for continued injection of high pressure fluid down through the outer annulus to the cavity and closing the wash pipe for causing the fluid and any removed material to exit up through the inner annulus, while continuously maintaining high fluid pressure against the walls of the cavity, (8) commingling gravel pack sand with the injected fluid entering the outer annulus, (9) forming a gravel pack in the cavity against the outer surface of the screen as the high pressure fluid passes therethrough and out the inner annulus, while continuously maintaining high fluid pressure against the cavity walls to prevent caving-in and sloughing of the formation walls,

(10) detecting complete filling of the cavity and completion of the gravel pack and stopping gravel pack sand injection responsive to a pressure build-up in the outer annulus,

(11) running the production tubing back in the well for restarting oil production.

THE PREFERRED EMBODIMENT FOR PRACTICING THE INVENTION

The preferred system for carrying out the above method for placing a well in production that is drilled in an unconsolidated formation where cave-in and sloughing is a common and usual occurrence comprises first a mechanism or system for forming a larger cavity than usual in the well for holding a larger than the conventional sand pack for providing a larger pack drainage area and more sand filtering surface. Normally, this would require considerable underreaming with large unsupported walls resulting in cave-ins and sloughing.

FIG. 1 is a schematic diagrammatic vertical sectional view of the apparatus for sand control of an unconsolidated sand formation, and particularly a petroliferous formation. Further, this apparatus may clean out an existing well, whether it is washing out a well that has sanded up, whether it is enlarging a previously drilled well, or whether it is drilling a large cavity in a new well through un unconsolidated petroliferous sand formation mentioned above.

The cased well hole 10, FIG. 1, has a wash pipe 11 with valve 2 centrally supported in the well with structure (not totally shown). A screen supporting tubing 13 is mounted around the wash pipe and equally spaced therefrom with structure (not shown) forming an inner annulus 14. At least one valve 15 is shown on inner annulus 14. An outer annulus 16 is formed between the screen tubing 13 and the well casing 10. Outer annulus 16 has two valves, 17 and 18, for example, for controlling fluid therethrough. Likewise, blowout preventers, 19 and 20 are illustrated on the wash pipe 11 and inner annulus 14, respectively. A third blowout preventer (not shown) may be utilized on the outer annulus 16, if desired. Sources of pumping high pressure fluids in either direction are illustrated schematically as pump 21 on the wash pipe 11, pump 22 on inner annulus 14, and pumps 23 and 24 on outer annulus 16, particularly for maintaining the internal fluid pressure in the well cavity greater than the overburden in the well cavity walls.

First, with the nozzles positioned as shown in FIG. 1, high pressure cold water is ejected into the well immediately below the bottom of the casing into the top of the petroliferous sand formation. The transition is then made with predetermined time intervals to high pressure hot water and then to high pressure steam for ejection from the horizontal nozzles into the surrounding formation for beginning the forming of the large capacity. Then if a nozzle with only one or only a few jet orifices is utilized, the wash pipe and nozzle are rotated and lowered simultaneously slowly for washing out the large cavity 25 with steam ejection.

FIG. 1 shows a typical 16 foot (about 5 meters) diameter cylinder for example, washed out initially at the very beginning. Then as the wash pipe 11 is lowered slowly for only the depth of the petroliferous strata 24 of the unconsolidated formation to the position of FIG. 2, a large cylindrical shaped cavity 25 is formed for a typical depth of 24 feet (about 7 meters) for example. A nozzle housing 26 having a plurality of orifices 27, FIGS. 1–2, preferably, is attached to the lower end of a screen 28 which in turn is attached to the lower end of a support tube 29 on the lower end of the drilling string (not shown).

While a two orifice nozzle requires rotation as it is lowered in the well for washing out a cavity as illustrated in Assignee's U.S. Pat. No. 4,066,127, issued Jan.

3, 1978, with several orifices 27, FIG. 1, around the periphery of the nozzle 26, mere lowering of the nozzle slowly is sufficient to wash out the cavity 25, if so desired.

The formation sand returns are carefully monitored for estimating the size of the well cavity as it is formed by washing out the unconsolidated formation.

Figure 2:
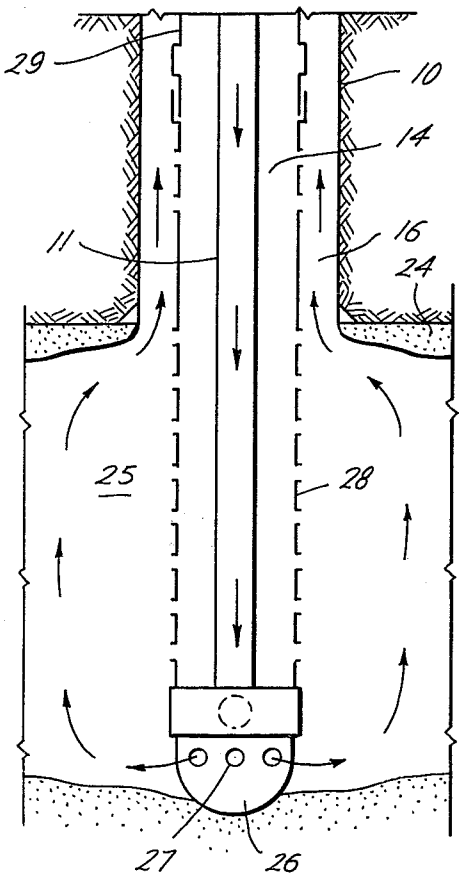
FIG. 2 is a schematic vertical sectional view of the well and apparatus of FIG. 1 after having completed the cavity therein wherein the spent fluid and removed formation material or "pulp" is being ejected from the outer annulus.

FIG. 2 illustrates the well cavity after it has been washed out to the final or total depth (TD). The high pressure fluid pump 21, as a water pump for example, maintains high fluid pressure in the wash pipe 11, and with valve 12 open, maintains high fluid pressure in the well and against the overburden or pressure in the walls of the cavity 25 as they tend to cave-in and slough in. Likewise, high pressure fluid pumps 22, 23, and 24 maintain high pressure in the cavity when their respective valves 15, 17, and 18 are opened as required.

Thus with opening of high pressure valve 12 in the wash pipe, the wash fluid circulation, as water, for example, is circulated down wash pipe 11, FIGS. 1–2, out the nozzle orifice 27, through the cavity 25 picking up any loose material, and ejecting it up the outer annulus 16 through valves 17 and 18 for maintaining a high positive fluid pressure against the walls of the cavity for preventing caving-in and sloughing of the cavity walls, FIG. 2.

REVERSAL OF FLOW STEPS

Figure 3:
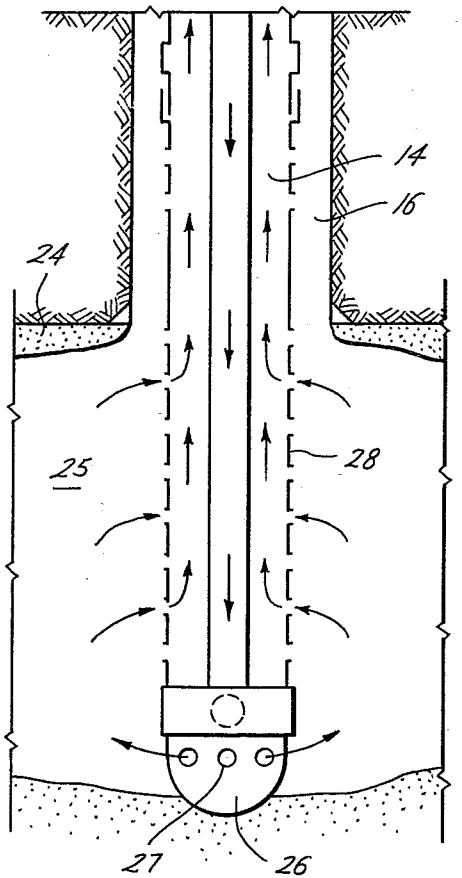
FIG. 3 is a schematic vertical sectional view of the well of FIG. 2 with the fluid flow of spent fluid from the outer annulus having been changed to exit from the inner annular after the formation material has been removed.

FIG. 3 shows the first step in reversing the fluid flow of FIG. 2 for eventually depositing the gravel pack in the large cavity. The inner annulus valve 15, FIG. 1, is opened while simultaneously, outer annulus valves 17 and 18 are closed in making the change over of ejecting the cavity fluids up and out of the inner annulus 14 instead of the outer annulus 16. During this change of ejected fluids, the valves 15 and 17, 18 are operated gradually and simultaneously in order to maintain the high positive fluid pressure on the walls of the cavity, to prevent caving-in and sloughing of the cavity walls, FIG. 4.

Figure 4:
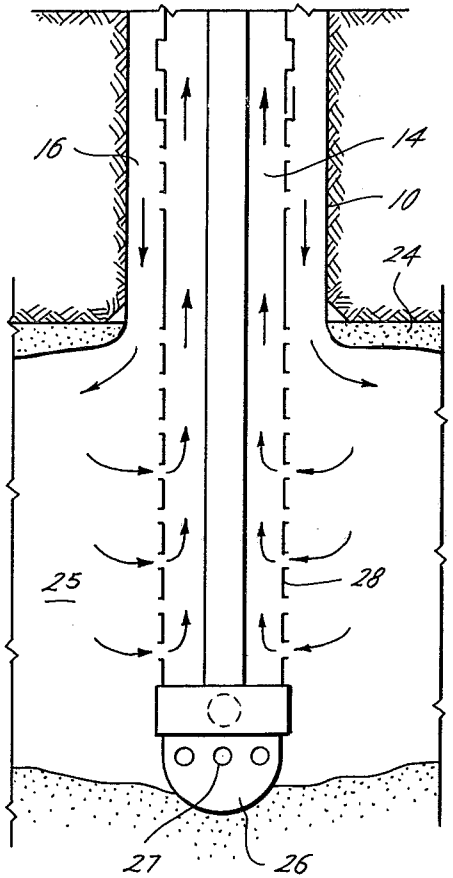
FIG. 4 is a schematic vertical sectional view of the well of FIG. 3 with the fluid flow illustrated as having been changed by ceasing flow in the wash pipe and simultaneously beginning flow down the outer annulus.

FIG. 4 illustrates the resultant fluid flow after the outer annulus valves 17 and 18, FIG. 1, are opened and gradually and simultaneously, or with a slight delay, the wash pipe valve 12 is closed for changing the inlet fluid flow from the wash pipe 11 to the outer annulus 16. During this change over of injected fluids, valves 12 and 17, 18 are operated simultaneously in order to maintain the high positive fluid pressure on the walls of the cavity to prevent caving-in and sloughing of the cavity walls, FIG. 5. Now total reversal of fluid has been accomplished while maintaining the high positive pressure on the cavity walls.

Figure 5:
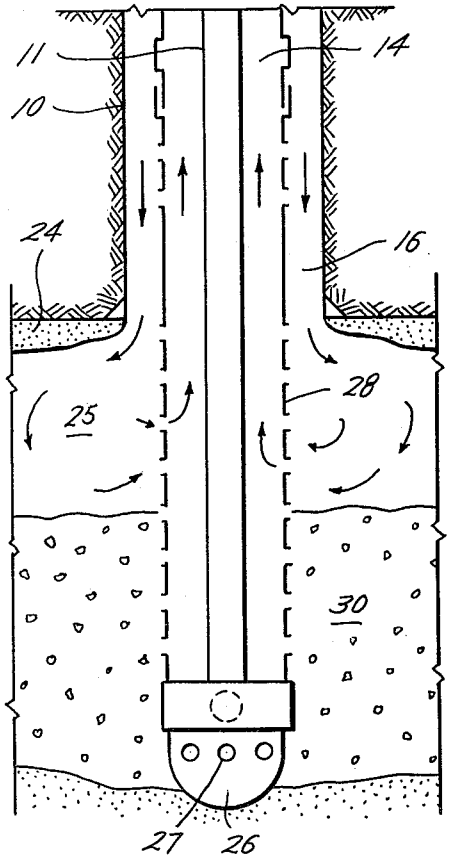
FIG. 5 is a schematic vertical sectional view of the well of FIG. 4 with sand being commingled with the incoming fluid flow for forming a sand pack in the well cavity.

Then, one of the valves 17 or 18, FIG. 5, is operated to commingle sand with the injection fluid as it is ejected down the wash pipe 11 to the cavity 25 for forming a sand pack 30 while maintaining high fluid pressure against the overburden for preventing cave-in and sloughing of the unconsolidated formation well walls. The sand fills the cavity from bottom up, and is filtered out on the screen as the injection fluid returns up the inner annulus 14 after passing through the screen 28. As the sand pack 30 is formed completely around the screen, the increased fluid pressure in outer annulus 16 will so indicate the filling of the cavity and thus the completion of the sand pack.

Figure 6:
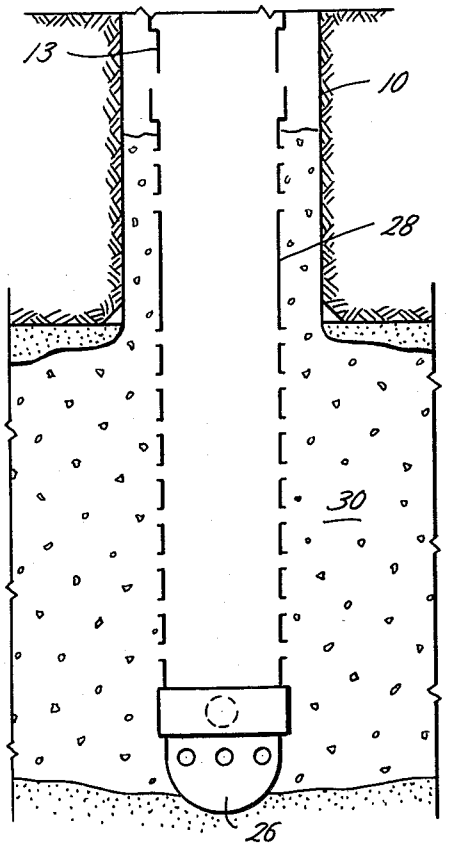
FIG. 6 is a schematic vertical sectional view of the well of FIG. 5 after completion of the gravel pack has been detected and the wash pipe has been removed and the screen support tube is being removed.

As illustrated in FIGS. 1 and 6, the large blowout preventer 20 is removed and then the wash pipe 11 and screen supporting tubing 13 are removed.

Figure 7:
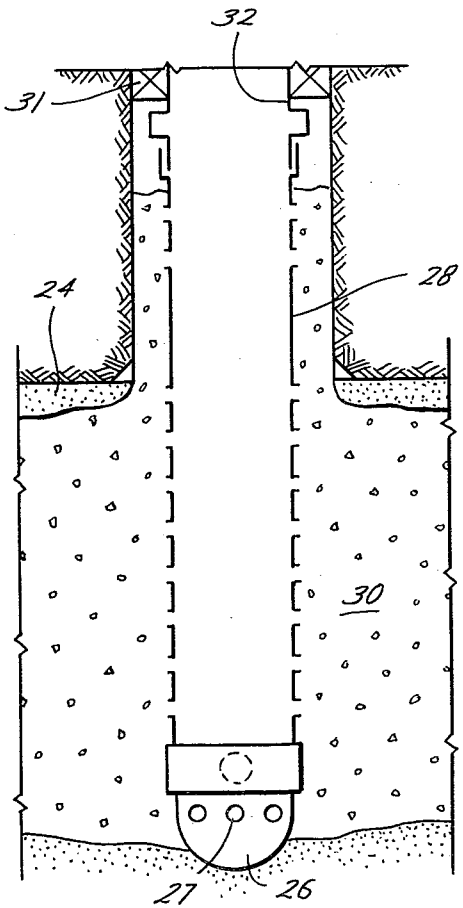
FIG. 7 is a schematic vertical sectional view of the well of FIG. 6 with the production tube not shown and with a packer have been installed for placing the well in production status.

FIG. 7 illustrates that after the circulation has stopped, then the small blowout preventer 19 is removed, a packer 31 is lowered in position, and a production tube 32 is connected to the top of the screen and packed to place the well in production status for flowing fluids, as crude oil from the petroliferous unconsolidated sand formation flows through the sand pack, through the screen, and up the production tube to the surface, a pump being added if necessary.

Accordingly, it will be seen that the disclosed well production system for carrying out the methods to prevent cave-in and sloughing in unconsolidated formations will operate in a manner which meets each of the objects set forth hereinbefore.

While only one method has been disclosed and only one mechanism has been disclosed for performing the methods, it will be evident that various other modifications are possible in the arrangement and construction of the well production system.

I claim:

1. A method of sand control comprising a method for reversal of circulation in a well in an unconsolidated sand formation having an outer annulus formed between a screen supporting tube suspended in the well and the sides of the well, and an inner annulus formed between the screen supporting tube and a wash pipe suspensed therein for having high pressure wash fluids flowing down the wash pipe for washing out a cavity and with the fluids and removed material exhausting up and through the outer annulus to the surface, comprising the steps of, (a) controlling the high pressure fluid into the wash pipe for ejecting it out of at least one horizontal nozzle for forming the cavity in the unconsolidated sand formation, (b) controlling the flow of the high pressure exhaust fluids and removed material from the outer annulus for maintaining the high fluid pressure against the walls of the cavity, (c) opening the inner annulus and closing the outer annulus for controlling the high pressure injected fluid flow into the cavity from the wash pipe and for controlling exhaust of the high pressure fluid from the inner annulus while continuously maintaining the high fluid pressure against the cavity walls, and (d) opening the outer annulus for injection of high pressure fluid down through the outer annulus to the cavity and closing the wash pipe for causing reversal of flow through the two annuli for causing the fluid and any removed material to continue exhausting from the inner annulus while maintaining the high fluid pressure against the formation cavity walls to prevent cave-in and sloughing of the cavity walls until a sand pack is formed and the well producing.

2. A method as recited in claim 1 comprising further, (a) controlling the high pressure fluid through each of the wash pipe, the inner annulus, and the outer annulus with valves in each for continuously maintaining the high fluid pressure against the cavity walls.

3. A method as recited in claim 1 wherein the second step comprises further, (a) controlling the high pressure fluid through the outer annulus with at least two valves for full control of the fluid flow for continuously maintaining the high fluid pressure against the cavity walls.

4. A method as recited in claim 1 comprising further, (a) making the transition from injecting high pressure cold wash water in the well to injecting high pressure hot wash water, to injecting high pressure steam within predetermined periods of time prior to lowering and rotating the nozzle for forming the large cavity in the formation while continuously maintaining high fluid pressure against the cavity walls for prevention of thermal shock in the unconsolidated sand formation.

5. A method as recited in claim 1 wherein the first method step comprises further, (a) ejecting the high pressure wash pipe fluid in at least two horizontal jets directed 180° from each other for quickly and efficiently washing out the cavity, the jets being slowly rotated and lowered in the unconsolidated sand formation of the well.

6. A method of sand control of unconsolidated petroliferous sand formation in a well comprising, (a) removing all production tubing from the well, (b) supporting a nozzle from the bottom of a wash pipe, (c) surrounding the wash pipe with a screen supported by a screen support tubing forming an inner annulus between the wash pipe and the screen support tubing and forming an outer annulus between the screen support tubing and the wall of the well, from the top of the unconsolidated sand formation to the bottom thereof, (d) injecting high pressure fluid down the wash pipe and out the horizontal nozzle for forming a cavity in the petroliferous sand formation and discharging the removed material up through the outer annulus, (e) controlling fluid flow through each of the three conduits comprising the wash pipe, the inner annulus, and the outer annulus for maintaining the cavity under high fluid pressure to prevent caving-in and sloughing of the formation walls, (f) opening the inner annulus and closing the outer annulus for causing high pressure injection fluid flow into the cavity from the wash pipe and through the screen to exit from the inner annulus, while continually maintaining the high fluid pressure against the cavity walls, (g) opening the outer annulus for continued injection of high pressure fluid down through the outer annulus to the cavity and closing the wash pipe for causing the fluid and any removed material to exit up through the inner annulus, while continuously maintaining the high fluid pressure against the walls of the cavity, (h) commingling gravel pack said with the injected fluid entering the outer annulus, (i) forming a gravel pack in the cavity against the outer surface of the screen as the high pressure fluid passes therethrough and out the inner annulus, while continuously maintaining high fluid pressure against the cavity walls to prevent cave-in and sloughing of the formation walls, (j) detecting complete filling of the cavity and completion of the gravel pack and stopping gravel pack sand injection responsive to a pressure build-up in the outer annulus, (k) running the production tubing back in the well for restarting oil production.

7. A method as recited in claim 6 wherein the third method step comprises further, (a) making the transition from injecting high pressure cold wash water, to high pressure hot wash water, to high pressure steam within predetermined periods of time prior to lowering and rotating the nozzle for forming the large cavity in the formation, while continuously maintaining high fluid pressure against the cavity walls and for prevention of thermal shock in the unconsolidated petroliferous sand formation.

8. A method as recited in claim 6 wherein the fourth method step comprises further, (a) forming the horizontal nozzle into two horizontal nozzles, 180° opposite to each other for quickly and efficiently washing out the cavity, as the nozzles are slowly lowered and rotated in the unconsolidated petroliferous sand formation.

9. A method as recited in claim 6 wherein the fourth method step comprises further, (a) mounting at least one valve in each of the wash pipe, the inner annulus, and the outer annulus for controlling the fluid therethrough each for continuously maintaining high pressure fluid against the cavity walls for prevention of cave-in and sloughing thereof.

10. A method as recited in claim 6 wherein the third method step comprises further, (a) inserting a valve in each of the conduits comprising the wash pipe, inner annulus, and outer annulus for controlling the flow in their respective conduits for continuously maintaining the cavity under high fluid pressure to prevent cave-in and sloughing of the formation walls.

11. A method as recited in claim 6 wherein the fourth method step comprises further, (a) mounting at least one valve in the wash pipe, at least one valve in the inner annulus, and at least two valves in the outer annulus for controlling the fluid therethrough each for continuously maintaining high pressure fluid against the cavity walls for prevention of cave-in and sloughing thereof during forming of the cavity.

12. A method for producing a well in an unconsolidated formation while preventing cave-in and sloughing during working in the well wherein the well has a tube supported screen extending down to the bottom thereof with a wash tube centered in the screen extending from a source of high pressure drilling fluid to a horizontal nozzle at the bottom of the screen for washing out an enlarged cavity wherein an inner annulus is formed between the wash pipe and the screen and an outer annulus is formed between the screen and the well walls and there being valves for controlling fluid flow through both annuli and the wash pipe comprising the step of, (a) controlling the valves in both annuli for controlling the exhaust spent fluids and removed formation material from the outer annulus as it flows up from the cavity for maintaining a high fluid pressure against the walls of the cavity higher than the overburden pressure in the walls for preventing cave-in and sloughing of the unconsolidated formation well walls.

13. A method as recited in claim 12 wherein the method step includes further, (a) washing out the cavity with a nozzle having at least two 180° spaced apart orifices for efficient removal of the unconsolidated formation well walls.

14. A method as recited in claim 12 or 13 wherein the method step comprises further, (a) injecting cold wash water, hot wash water, and steam in consecutive order while continuously maintaining high fluid pressure to resist the overburden and for prevention of thermal shock in the unconsolidated sand formation.

15. A method as recited in claim 12 wherein the method step comprises further, (a) gradually beginning exit flow of the spent drilling fluid up out of the inner annulus with gradual ceasing of flow from the outer annulus while maintaining high fluid pressure against the overburden for preventing cave-in and sloughing of the unconsolidated formation well walls.

16. A method as recited in claims 12 or 15 wherein the method step comprises further, (a) gradually beginning fluid flow down into the outer annulus to the cavity with gradual simultaneous ceasing of wash fluid flow down the wash tube while maintaining a constant high fluid pressure against the well walls for preventing cave-in and sloughing of the unconsolidated formation well walls.

17. A method as recited in claim 12 wherein the method step comprises further, (a) commingling and injecting sand with injection fluid down the outer annulus for filling the cavity with a sand pack while maintaining high fluid pressure against the overburden for preventing cave-in and sloughing of the unconsolidated formation well walls until the sand pack is completed.

18. A method as recited in claims 12 or 17 wherein the method step comprises further, (a) removing the wash tube and the tubing for supporting the screen upon complete filling of the cavity with the sand pack.

19. A method as recited in claim 12 wherein the method step comprises further, (a) supplying production tube means and packer means for the unsupported screen means for providing full production of fluids from the well in the unconsolidated formation.

* * * * *